US009206522B2

(12) United States Patent
Cho et al.

(10) Patent No.: US 9,206,522 B2
(45) Date of Patent: Dec. 8, 2015

(54) ELECTRONIC DEVICE CASE AND SURFACE TREATMENT METHOD THEREOF

(71) Applicant: Samsung Electronics Co., Ltd., Gyeonggi-do (KR)

(72) Inventors: Sung-Ho Cho, Gyeonggi-do (KR); Woon-Sik Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 148 days.

(21) Appl. No.: 13/650,735

(22) Filed: Oct. 12, 2012

(65) Prior Publication Data

US 2013/0093299 A1 Apr. 18, 2013

(30) Foreign Application Priority Data

Oct. 14, 2011 (KR) ..... 10-2011-0104997

(51) Int. Cl.

| | |
|---|---|
| ***H05K 5/04*** | (2006.01) |
| ***B21C 23/24*** | (2006.01) |
| ***C25D 11/16*** | (2006.01) |
| ***C25D 11/24*** | (2006.01) |

(52) U.S. Cl.

CPC ..... *C25D 11/16* (2013.01); *C25D 11/246* (2013.01)

(58) Field of Classification Search

None

See application file for complete search history.

(56) References Cited

U.S. PATENT DOCUMENTS

| | | | | |
|---|---|---|---|---|
| 5,775,892 | A * | 7/1998 | Miyasaka et al. | 418/55.2 |
| 6,623,614 | B2 | 9/2003 | Hsu | |
| 2010/0183869 | A1* | 7/2010 | Lin et al. | 428/332 |

FOREIGN PATENT DOCUMENTS

| | | | |
|---|---|---|---|
| KR | 10-0852144 B1 | | 8/2008 |
| KR | 20090123615 | * | 2/2009 |
| KR | 10-2009-0123615 A | | 12/2009 |
| KR | 10-2009-0130259 A | | 12/2009 |
| KR | 1020120045469 | * | 5/2012 |

OTHER PUBLICATIONS

KR102009123615_human translation. Dec. 2, 2009, 1-17.*

* cited by examiner

*Primary Examiner* — Vera Katz

(74) *Attorney, Agent, or Firm* — Cha & Reiter, LLC

(57) ABSTRACT

An electronic device case and a surface treatment method thereof are provided in which an exterior case is diecast of an aluminum alloy, an aluminum alloy layer is deposited on an outer surface of the exterior case, an oxidized coating layer is formed on a surface of the aluminum alloy layer, and a sealing layer is formed atop the oxidized coating layer and may seal pores therein. A pigment colored layer may be formed between the oxidized coating layer and the sealing layer.

9 Claims, 2 Drawing Sheets

ELECTRONIC DEVICE CASE AND SURFACE TREATMENT METHOD THEREOF

CLAIM OF PRIORITY

This application claims priority under 35 U.S.C. §119(a) to a Korean Patent Application filed in the Korean Intellectual Property Office on Oct. 14, 2011 and assigned Serial No. 10-2011-0104997, the contents of which are incorporated herein by reference.

BACKGROUND

1. Technical Field

The present disclosure relates to an electronic device case and a method for treating the surface of the electronic device case, and more particularly, to an electronic device case and a surface treatment method thereof, for enabling uniform coloring of a diecast aluminum alloy surface in various hues.

2. Description of the Related Art

In general, the exterior case of an electronic device is manufactured from plastic, a magnesium alloy, or an aluminum alloy. In particular, the exterior case of a portable electronic device should be lightweight and have good corrosion resistance, good shock resistance, and high yield strength in view of the harsh environment expected from portability. For exterior cases of various looks and sophisticated designs, a number of surface finishes should be possible.

A plastic surface, however, is vulnerable to scratches and has a low strength. Moreover, plastic cannot shield electromagnetic waves emitted from an electronic device. That's why aluminum or magnesium is usually used for the exterior case of a portable electronic device. Pressing or diecasting are manufacturing methods suitable for molding an aluminum or magnesium exterior case.

A conventional technology for press-molding an aluminum alloy is disclosed in Korea Laid-Open Publication No. 10-2009-0130259 (published on Dec. 21, 2009) entitled "Aluminum Alloy Plate for Press Molding".

However, if an electronic device case is molded by press molding, it is difficult to manufacture the electronic product comprising the case into a complex shape. Therefore, diecasting is more popular in manufacturing an exterior case of a relatively complex shape.

Conventional technologies for a diecast aluminum alloy and surface treatment of an electronic device using the same are disclosed in Korea Patent No. 10-0852144 (registered on Aug. 7, 2008) entitled "Die Casting Aluminum Alloy for Frame of Mobile Electronic Equipment and Painting Method for Frame Using the Same" and Korea Patent No. 10-1016278 (registered on Feb. 14, 2011) entitled "Method of Surface Treatment for Die Casting Materials for Mobile Phone Case, and the Structure".

However, a diecast aluminum alloy surface is chemically nonuniform due to external exposure of an Si component included in the aluminum alloy, is nonuniform in its crystal structure due to coagulation, or is physically nonuniform, such as pores caused by air introduced during pressing. As a result, the surface of an exterior case is difficult to paint in an intended sophisticated hue and to color through anode oxidation coating.

Although a aluminum alloy component is controlled in cast of diecast to prevent the diecast aluminum alloy surface from being nonuniform, this decreases the strength of the diecast aluminum alloy.

To facilitate surface finishes including painting or plating on the diecast aluminum alloy surface, an aluminum layer is deposited and then the surface of the aluminum layer is subjected to anode oxidation. However, because aluminum on the aluminum alloy surface is very vulnerable to corrosion and has a low strength, the adhesive strength of the aluminum layer is reduced after anode oxidation coating. Consequently, pigment coloring, plating, and painting of the surface of the oxidized coating layer are not easily performed in a manner that achieves a desired quality finish. A colored or painted layer can be easily peeled off from the aluminum layer, which makes it difficult to commercialize anode oxidation on a diecast aluminum alloy surface.

SUMMARY

An aspect of embodiments disclosed herein is to provide an electronic device case and a surface treatment method thereof, for enabling uniform coloring of the surface of an exterior case manufactured of a diecast aluminum alloy by anode oxidation coating, coloring, and sealing and enabling painting of the surface of the exterior case in various hues.

In an illustrative embodiment, there is provided an electronic device case in which an exterior case is diecast of an aluminum alloy, an aluminum alloy layer is deposited on an outer surface of the exterior case, an oxidized coating layer is formed on a surface of the aluminum alloy layer, and a sealing layer is formed atop a surface of the oxidized coating layer. The sealing layer may smooth the surface of the oxidized coating layer by sealing pores included in the oxidized coating layer.

The aluminum alloy layer may be 5 to 100 μm thick, and may contain silicon (Si), magnesium (Mg), and manganese (Mn) in addition to a main material being aluminum (Al). The aluminum alloy layer may be formed by Physical Vapor Deposition (PVD).

The oxidized coating layer may be 5 to 100 μm thick.

The surface of the aluminum alloy layer may be polished before the oxidized coating layer is formed on the aluminum alloy layer.

A pigment colored layer may further be formed for coloring the pores within in the oxidized coating layer with a pigment. The pigment colored layer is between the oxidized coating layer and the sealing layer.

In accordance with another embodiment of the present invention, there is provided a method for producing an electronic device case, and treating its surface. The method includes diecasting an exterior case of an aluminum alloy; and forming an aluminum alloy layer on a surface of the diecast aluminum alloy to form the main body of the electronic case. The surface of the electronic case is treated by: forming an oxidized coating layer on a surface of the aluminum alloy layer by anode-oxidizing the surface of the aluminum alloy layer; and forming a sealing layer atop oxidized coating layer. A colored pigment layer may be formed between the oxidized coating layer and the sealing layer.

BRIEF DESCRIPTION OF THE DRAWINGS

The above and other aspects, features and advantages of certain embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EXEMPLARY EMBODIMENTS

Figure 1:
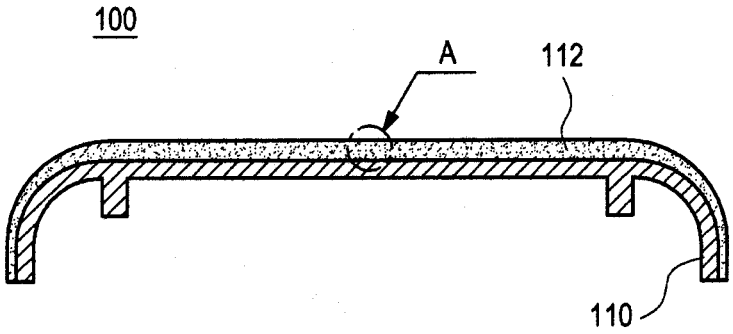
FIG. 1 illustrates an end view of an electronic device case according to an embodiment of the present invention.

An electronic device case and a surface treatment method thereof according to an embodiment of the present invention will be described with reference to the attached drawings. For clarity and simplicity of description, lines and components illustrated in the drawings may be emphatically shown in thickness and size. The terms described below are defined in connection with the function of the present invention. The meaning of terms may vary according to the user, the intention of the operator, usual practice, etc. Therefore, the meanings of terms used in this disclosure are intended to be construed in accordance with any definitions herein and to be consistent with the description set forth herein.

Figure 2:
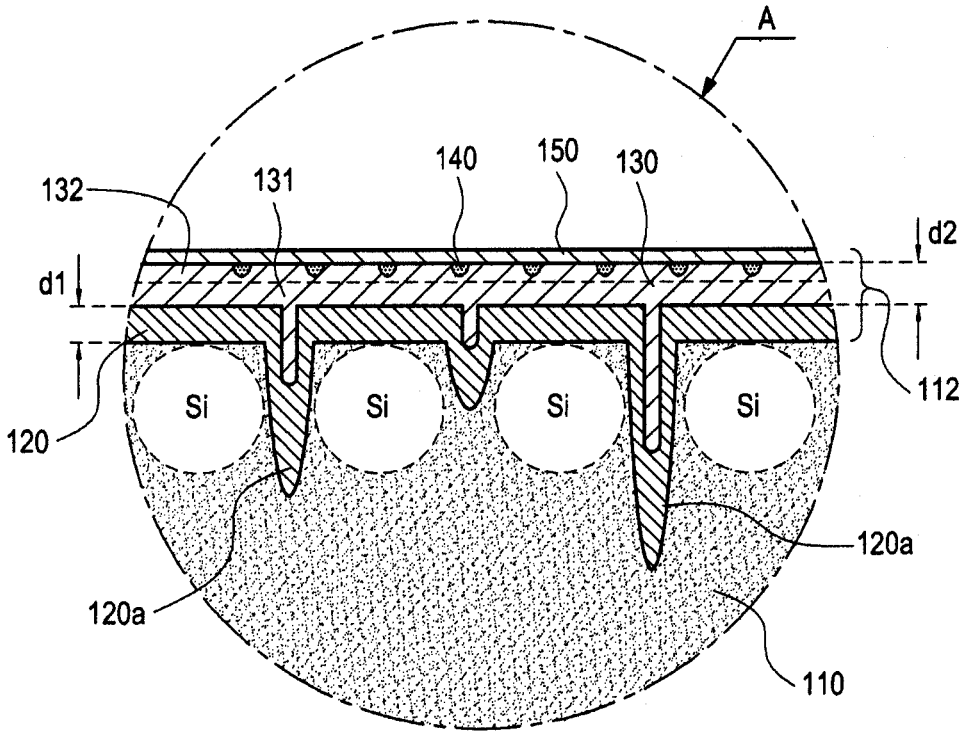
FIG. 2 is an enlarged view of a part A illustrated in FIG. 1.

FIG. 1 illustrates an end view of an electronic device case, 100, according to an embodiment of the present invention. FIG. 2 is an enlarged view of a part A illustrated in FIG. 1. As shown in FIG. 1 electronic device case 100 includes a main exterior case 110 and finishing layers 112 formed on exterior case 110. The thickness of finishing layers 112 is substantially less than that of exterior case 110; however, in FIG. 1, the thickness of finishing layers 112 is exaggerated for clarity of illustration.

The exterior case 110 is formed by diecasting an aluminum alloy, and thus the electronic device case 100 itself is a case that is shaped by diecasting. While the exterior case 110 is described as a diecast aluminum alloy in the embodiments detailed below, other diecast metal alloys are alternatively possible and are within the scope of further embodiments. For instance, exterior case 110 can be alternatively fabricated as a diecast magnesium alloy.

The external surface of the exterior case 110 (i.e., the surface interfacing with finishing layers 112) is nonuniform due to a number of factors. First, because silicon (Si) is externally exposed on the surface of the exterior case 110 diecast of the aluminum alloy, the surface of the exterior case 110 is chemically nonuniform. In addition, its crystal structure is nonuniform due to coagulation. Further nonuniformity of the exterior case 110 surface is due to surface pores formed due to air introduced during pressing involved in diecasting. As discussed earlier, in conventional devices, such nonuniformity makes it difficult to paint and finish the surface with a desired quality. Embodiments of the present invention alleviate or eliminate this problem.

Referring to FIG. 2, an aluminum alloy layer 120 is formed on the nonuniform surface of the exterior case 110. Aluminum alloy layer 120 can be formed on the surface of the exterior case 110 by Physical Vapor Deposition (PVD) such as evaporation, sputtering, or ion plating.

The aluminum alloy layer 120 has a thickness d1 which can be in the range of about 5 to 100 μm thick. To more easily achieve uniform coloring to the electronic device case 100, the thickness d1 of the aluminum alloy layer 120 is preferably in the range of about 80 to 100 μm. The aluminum alloy of the aluminum alloy layer 120 contains secondary materials such as silicon (Si), magnesium (Mg), and manganese (Mn) in addition to a main material, aluminum (Al). The addition of the secondary materials increases the adhesive strength of the aluminum alloy 120 when the aluminum alloy layer 120 is deposited on the surface of the exterior case 110. It is noted, however, that the thickness d1 and materials of the aluminum alloy layer 120 are not limited to the above specific details. Any alternative thickness and materials of the aluminum alloy layer 120 can be suitable, as long as they preferably: i) facilitate adhesive formation of the aluminum alloy layer 120 onto the surface of the exterior case 110; ii) maintain the aluminum alloy layer 120 adhesiveness to the surface of the exterior case 110 after the formation thereof; and iii) increase the adhesive strength of the oxidized coating layer 130 formed subsequently on the aluminum alloy layer 120.

The top surface of the diecast aluminum alloy electronic case 110 contains ball-like silicon structures denoted as "Si", which is a partial cause of nonuniformity of the surface of electronic case 110. In addition, surface pores are formed on the electronic case 110 surface. As shown in FIG. 2, aluminum alloy layer 120 fills in these pores during its deposition and thereby extends to form icicle-like structures 120*a* within the diecast aluminum alloy case 110. The icicle structures 120*a* themselves can have centralized channels as shown, which are subsequently filled in by a portion of an oxidized coating layer 130.

The oxidized coating layer 130 can be formed on the aluminum alloy layer 120 by subjecting the surface of the aluminum alloy layer 120 to anode oxidation. The oxidized coating layer 130 can be about 5 to 100 μm thick on the aluminum alloy layer 120. Preferably, to more easily produce uniform coloring on the surface of the electronic device case 100, the thickness d2 of the oxidized coating layer 130 is about 80 to 100 μm in embodiments of the present invention.

The surface of aluminum alloy layer 120 can be polished by chemical or electrolytic polishing before the oxidized coating layer 130 is formed thereon. Such polishing allows for the final surface of exterior case 110 to have a glossy hue after a pigment colored layer 140 and a sealing layer 150 are formed on the oxidized coating layer 130.

The oxidized coating layer 130 resulting from anode oxidation is divided into a dense barrier layer 131 and a porous layer 132 atop barrier layer 131, where porous layer 132 has a plurality of pores. In embodiments that include the pigment colored layer 140, the pores of porous layer 132 are filled by pigment color layer 140. The sealing layer 150 is formed on the oxidized coating layer 130 by sealing such as hydration sealing, metal sealing, organic sealing, or low-temperature sealing, thereby sealing the pores of the porous layer 132 (which are already filled in by the pigment colored layer 140 as shown). Therefore, the surface of the oxidized coating layer 130 is rendered uniform. Sealing layer 150 increases the corrosion resistance of the oxidized coating layer 130. Further, in embodiments that include pigment colored layer 140, the sealing layer 150 increases the climate resistance and durability of coloring and also increases the corrosion resistance of the oxidized coating layer 130.

The pigment colored layer 140 is formed on the oxidized coating layer 130 under the sealing layer 150 by coloring the surface of the exterior case 110 with an intended pigment. Specifically, the pigment colored layer 140 may be formed by coloring the porous layer 132 using a coloring method such as organic coloring, inorganic coloring, or electrolytic coloring, to thereby give an intended hue to the surface of the exterior case 110 and improve the aesthetic appearance of electronic device case 100.

Thus, as described above, the surface of the diecast exterior case 110 becomes stronger by depositing the aluminum alloy layer 120 on the surface thereof. The additional formation of the oxidized coating layer 130, the pigment colored layer 140, and the sealing layer 150 enhances the outward look of the exterior case 110 and gives the finished surface a uniform hue.

Now, a surface treatment method for the electronic device case according to an embodiment of the present invention will be described below.

Figure 3:
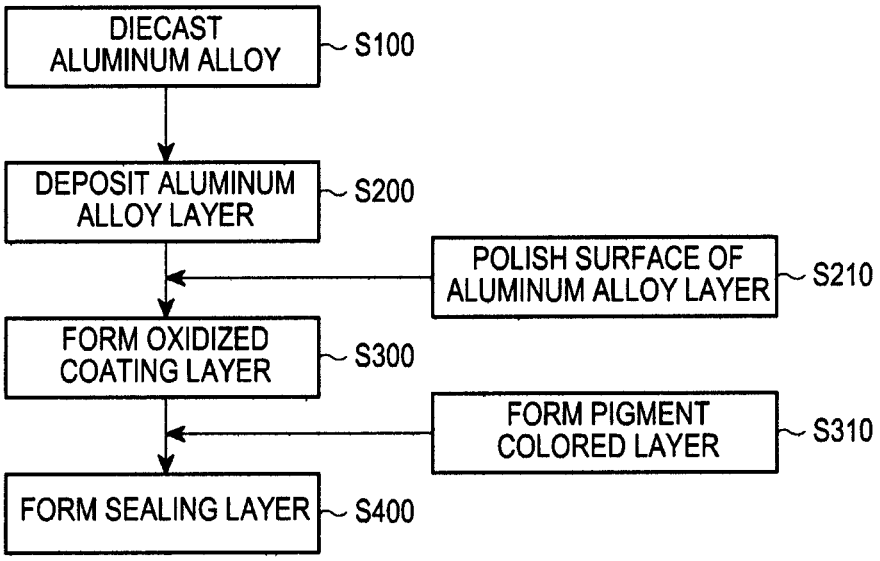
FIG. 3 is a flowchart illustrating a method for treating the surface of the electronic device case according to an embodiment of the present invention.

FIG. 3 is a flowchart illustrating a method for treating the surface of the electronic device case according to an embodiment of the present invention. At step 100, the exterior case 110 is shaped by diecasting with an aluminum alloy. Since silicon (Si) included in the aluminum alloy is exposed to the outside during the diecasting, the surface of the exterior case 110 is chemically nonuniform. In addition, its crystal structure is nonuniform due to coagulation, and air introduced by pressing during the diecasting further contributes to the surface nonuniformity.

After the diecasting in step S100, the aluminum alloy layer 120 is formed on the nonuniform surface of the exterior case 110 by PVD such as evaporation, sputtering, or ion plating in step S200. To increase the adhesive strength of the aluminum alloy layer 120 on the surface of the exterior case 110, the aluminum alloy of the aluminum alloy layer 120 may contain silicon (Si), magnesium (Mg), and/or manganese (Mn) in addition to the main material, aluminum (Al). The aluminum alloy layer 120 can be about 50 to 100 μm thick on the surface of the exterior case 110. Preferably, the thickness of the aluminum alloy layer 120 is about 80 to 100 μm on the surface of the exterior case 110 to render the exterior case 110 colored in a uniform hue.

Subsequently, the surface of the aluminum alloy layer 120 can be polished, if desired, by electrolytic or chemical polishing in step 210 in step S210. By subjecting the surface of the aluminum alloy layer 120 to such polishing, exterior case 110 may be produced having a glossy hue after the pigment colored layer 140 and the sealing layer 150 are formed on the oxidized coating layer 130.

After the aluminum alloy layer 120 is deposited in step S200 or (optionally) the surface of the aluminum alloy layer 120 is polished in step S210, the oxidized coating layer 130 is formed on the aluminum alloy layer 120 by subjecting the surface of the aluminum alloy layer 120 to anode oxidation in step S300. The aluminum alloy layer 120 can be anode-oxidized so that the thickness d2 of the oxidized coating layer 130 is 5 to 100 μm. Preferably, the thickness d2 of the oxidized coating layer 130 is about 80 to 100 μm to more easily achieve a uniform hue for exterior case 110. The oxidized coating layer 130 includes the dense barrier layer 131 and the porous layer 132 having a multiplicity of pores.

The sealing layer 150 is formed on the oxidized coating layer 130 by sealing such as hydration sealing, metal sealing, organic sealing, or low-temperature sealing and thus sealing the pores of the porous layer 132 in step S400. Because the top of the oxidized coating layer 130 or the pigment colored layer 140 is sealed, the climate resistance and durability of the pigment colored layer 140 and the corrosion resistance of the oxidized coating layer 130 are increased.

Before the sealing layer 150 is formed in S400 after the formation of the oxidized coating layer 130, the pigment colored layer 140 can be formed by coloring the surface of the oxidized coating layer 130 in step S310. That is, the porous layer 132 of the oxidized coating layer 130 is colored with an intended pigment in a pigment coloring method such as organic coloring, inorganic coloring, or electrolytic coloring, thereby coloring the surface of the exterior case 110 in an intended hue.

Since the aluminum alloy layer 120 of a diecast aluminum alloy is deposited on the surface of the exterior case 110, the surface strength of the exterior case 110 is increased. The deposition of the aluminum alloy layer 120 also increases the adhesiveness between the exterior case 110 and the aluminum alloy layer 120. Therefore, the subsequently formed oxidized coating layer 130, pigment colored layer 140, and sealing layer 150 become more adhesive and a uniform hue can be achieved. Consequently, commercialization of an exterior case diecast of an aluminum alloy can be promoted and thus the external appearance of the electronic device case 100 can be enhanced.

As is apparent from the above description of the present invention, the present invention increases the adhesive strength of the oxidized coating layer by depositing the aluminum alloy layer on the surface of the diecast aluminum alloy and subjecting the aluminum alloy layer to anode oxidation.

The increased adhesiveness of the oxidized coating layer leads to an increased adhesiveness of the subsequently formed pigment colored layer and sealing layer. Therefore, the aluminum alloy layer can be colored sophisticatedly and the surface of the exterior case can have a uniform hue. Consequently, the problems existing in conventional cases are overcome and the exterior case of a diecast aluminum alloy can be commercialized.

Owing to uniform coloring on the surface of the exterior case, various designs can be applied to the exterior case.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. An electronic device case comprising:

an exterior case diecast of an aluminum alloy, the exterior case including a first surface having a plurality of pores;

an aluminum alloy layer formed on the first surface of the exterior case, the aluminum alloy layer having a second surface that is in contact with the first surface of the exterior case, the second surface including a plurality of icicle-shaped structures that, extend into the pores;

an oxidized coating layer formed on a surface of the aluminum alloy layer; and a sealing layer atop a third surface of the oxidized coating layer, wherein each of the icicle-shaped structures includes a centralized channel that is filled in by a respective portion of the oxidized coating layer.

2. The electronic device case of claim 1, wherein the aluminum alloy layer is about 5 to 100 μm thick.

3. The electronic device case of claim 2, wherein the oxidized coating layer is about 5 to 100 μm thick.

4. The electronic device case of claim 1, wherein the aluminum alloy layer is about 80 to 100 μm thick.

5. The electronic device case of claim 1, wherein the aluminum alloy layer contains silicon (Si), magnesium (Mg), and manganese (Mn) in addition to a main material being aluminum (Al).

6. The electronic device case of claim 1, wherein the aluminum alloy layer is formed by Physical Vapor Deposition (PVD).

7. The electronic device case of claim 1, wherein the oxidized coating layer is about 80 to 100 μm thick.

8. The electronic device case of claim 1, wherein the surface of the aluminum alloy layer is polished before the oxidized coating layer is formed on the aluminum alloy layer.

9. The electronic device case of claim 1, further comprising a pigment colored layer for coloring pores included in the oxidized coating layer with a pigment.

* * * * *

UNITED STATES PATENT AND TRADEMARK OFFICE

CERTIFICATE OF CORRECTION

PATENT NO. : 9,206,522 B2
APPLICATION NO. : 13/650735
DATED : December 8, 2015
INVENTOR(S) : Sung-Ho Cho et al.

It is certified that error appears in the above-identified patent and that said Letters Patent is hereby corrected as shown below:

IN THE CLAIMS

Column 6, Claim 1, Line 42 should read as follows:
--...structures that extend into...--

Signed and Sealed this
Eighth Day of March, 2016

Michelle K. Lee

Michelle K. Lee
*Director of the United States Patent and Trademark Office*